US009052651B2

(12) United States Patent
Jeon

(10) Patent No.: US 9,052,651 B2
(45) Date of Patent: Jun. 9, 2015

(54) FUSING DEVICE AND ELETROPHOTOGRAPHIC IMAGE FORMING APPARATUS INCLUDING THE SAME

(71) Applicant: Samsung Electronics Co., Ltd., Suwon-si, Gyeonggi-do (KR)

(72) Inventor: Sang-uk Jeon, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/061,219

(22) Filed: Oct. 23, 2013

(65) Prior Publication Data

US 2014/0294458 A1 Oct. 2, 2014

(30) Foreign Application Priority Data

Mar. 26, 2013 (KR) ..... 10-2013-0032364

(51) Int. Cl.
*G03G 15/20* (2006.01)

(52) U.S. Cl.
CPC .... *G03G 15/2053* (2013.01); *G03G 2215/2035* (2013.01); *G03G 2215/0132* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 5,978,641 | A * | 11/1999 | Wayman et al. | 399/329 |
| 7,697,881 | B2 * | 4/2010 | Hayashi et al. | 399/399 |
| 2007/0065191 | A1 * | 3/2007 | Iwasaki et al. | 399/329 X |
| 2008/0317522 | A1 | 12/2008 | Ardery et al. | |
| 2010/0054827 | A1 | 3/2010 | Carr, Jr. et al. | |
| 2011/0229227 | A1 * | 9/2011 | Yoshikawa et al. | 399/329 |

OTHER PUBLICATIONS

Extended European Search Report dated Sep. 25, 2014 in corresponding European Patent Application No. 13189769.6.

* cited by examiner

*Primary Examiner* — Sandra Brase
(74) *Attorney, Agent, or Firm* — Staas & Halsey LLP

(57) ABSTRACT

A fusing device according to an embodiment of the present general inventive concept includes a pressing unit, a heating fusing belt contacts an outer surface of the pressing unit and rotates, a nib forming unit contacts an inner surface of the heating fusing belt and forms a nib at a contact portion between the pressing unit and the heating fusing belt, a first guide unit disposed at both end portions of the heating fusing belt so as to guide the movement of the heating fusing belt, and a second guide unit disposed between the first guide units and having a plurality of ribs which are arranged spaced apart from each other along a rotational direction of the heating fusing belt, so as to guide the movement of a central portion of the heating fusing belt.

31 Claims, 11 Drawing Sheets

FUSING DEVICE AND ELETROPHOTOGRAPHIC IMAGE FORMING APPARATUS INCLUDING THE SAME

CROSS-REFERENCE TO RELATED APPLICATIONS

This application claims priority under 35 U.S.C. §119 (a) from Korean Patent Application No. 10-2013-0032364, filed on Mar. 26, 2013, in the Korean Intellectual Property Office, the disclosure of which is incorporated herein by reference in its entirety.

BACKGROUND OF THE INVENTION

1. Field of the Invention

The present general inventive concept relates to a fusing device that fuses a toner image transferred onto a recording medium by using heat and pressure, and an electrophotographic image forming apparatus including the same.

2. Description of the Related Art

An electrophotographic image forming apparatus forms a latent image on a surface of a photosensitive medium by irradiating light demodulated according to image information onto the photosensitive medium and forms a visible toner image by supplying toner to the latent image. Then, the toner image is transferred onto a recording medium and fused on the recording medium while passing through a fusing device.

The fusing device fuses the toner image on the recording medium by applying heat and pressure to the transferred toner image. The fusing device includes a heating unit and a pressing roller, such that the pressing roller forms a fusing nib by contacting the heating unit. The heating unit generally includes a fusing belt that is rotated by being driven by the pressing roller, and a heat source, such as a halogen lamp, which is disposed inside the fusing belt. The heat source heats the fusing belt via convection and radiation through air.

The fusing device conventionally has a low heating efficiency, because heat is transferred from the heat source to the fusing belt through air. Moreover, the fusing device has a large heat capacity, which further prevents a rapid temperature rising performance with the fusing device.

In order to realize a high-speed operation of the image forming apparatus, a fusing device that rapidly increases the temperature and a method doing the same may be considered.

SUMMARY OF THE INVENTION

The present general inventive concept provides a fusing device that has enhanced durability and prevents deterioration in image quality.

Additional features and utilities of the present general inventive concept will be set forth in part in the description which follows and, in part, will be obvious from the description, or may be learned by practice of the general inventive concept.

The foregoing and/or other features and utilities of the present general inventive concept are achieved by providing a fusing device including a pressing unit, a heating fusing belt to contact an outer surface of the pressing unit and to rotate, a nib forming unit to contact an inner surface of the heating fusing belt and to form a nib at a contact portion between the pressing unit and the heating fusing belt, first guide units disposed at both end portions of the heating fusing belt so as to guide the heating fusing belt, and a second guide unit disposed between the first guide units and having a plurality of ribs spaced apart from each other along a rotational direction of the heating fusing belt so as to guide a central portion of the heating fusing belt.

The plurality of ribs of the second guide unit of the fusing device may extend in a direction crossing the rotational direction of the heating fusing belt.

At least a portion of the plurality of ribs may extend in a direction perpendicular to the rotational direction of the heating fusing belt.

At least a portion of the plurality of ribs may extend in a direction having an acute angle with the rotational direction of the heating fusing belt.

The plurality of ribs may be formed symmetrically with respect to a center line in a lengthwise direction of the heating fusing belt.

The heating fusing belt may have a nib section pressed by the pressing unit and a tension-free section where tension is released.

The heating fusing belt may include a base layer, a resistance heating layer formed on the base layer, and a release layer formed on the resistance heating layer.

The resistance heating layer may include a carbon nano tube.

A portion of the plurality of ribs may have a gap between the heating fusing belt and the plurality of ribs. The gap may be smaller than about 0.3 mm.

A virtual line connecting the plurality of ribs may correspond to at least a portion of a contour line of the first guide unit.

The plurality of ribs may be formed entirely along a lengthwise direction of the second guide unit.

The plurality of ribs may be formed intermittently along a lengthwise direction of the second guide unit.

The foregoing and/or other features and utilities of the present general inventive concept may also be achieved by providing an electrophotographic image forming apparatus including a photosensitive medium on which an electrostatic latent image is formed, a developer roller to supply toner onto the latent image to form a toner image on a recording medium, and a fusing device to apply heat and pressure to the toner image formed on the recording medium to fuse the toner image on the recording medium. The fusing device may include a pressing unit, a heating fusing belt to contact an outer surface of the pressing unit and to rotate, a nib forming unit to contact an inner surface of the heating fusing belt and to form a nib at a contact portion between the pressing unit and the heating fusing belt, first guide units disposed at both end portions of the heating fusing belt so as to guide the heating fusing belt, and a second guide unit disposed between the first guide units and having a plurality of ribs spaced apart from each other along a rotational direction of the heating fusing belt, so as to guide a central portion of the heating fusing belt.

The foregoing and/or other features and utilities of the present general inventive concept may also be achieved by providing a fusing device of an image forming apparatus to perform a rapid temperature increase including a pressing unit and a heating unit to contact a portion of an outer surface of the pressing unit. The fusing device may include a fusing belt to rotate in a paper feeding direction, at least one guide unit to circumferentially guide the fusing belt around the guide unit in the paper feeding direction, and a plurality of ribs longitudinally disposed on an outer surface of the at least one guide unit in directions substantially perpendicular to the paper feeding direction.

Each of the plurality of ribs may be in continuous contact with a portion of an inner circumferential surface of the fusing felt to prevent distortion of a center portion of the fusing belt with respect to end portions of the fusing belt.

The fusing device may include first guide units disposed at end portions of the fusing belt and a second guide unit disposed at a central portion of the fusing belt between the first guide units. The center portion of the fusing belt may not be distorted with respect to the end portions of the fusing belt.

Each of the plurality of ribs may be spaced apart from each other in the paper feeding direction.

The heating unit may include a nib forming unit to press a portion of the fusing belt to contact the portion of the outer surface of the pressing unit.

According to exemplary embodiments of the present general inventive concept, in the above-mentioned fusing device and the electrophotographic image forming apparatus including the same, when the fusing belt rotates, the fusing belt and the second guide unit guiding the fusing belt may be prevented from repeatedly contacting each other in a specific region, thereby preventing deterioration in the image quality and damage to the fusing belt.

The fusing belt of the heating unit may rotate in response to a rotation of the pressing unit.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
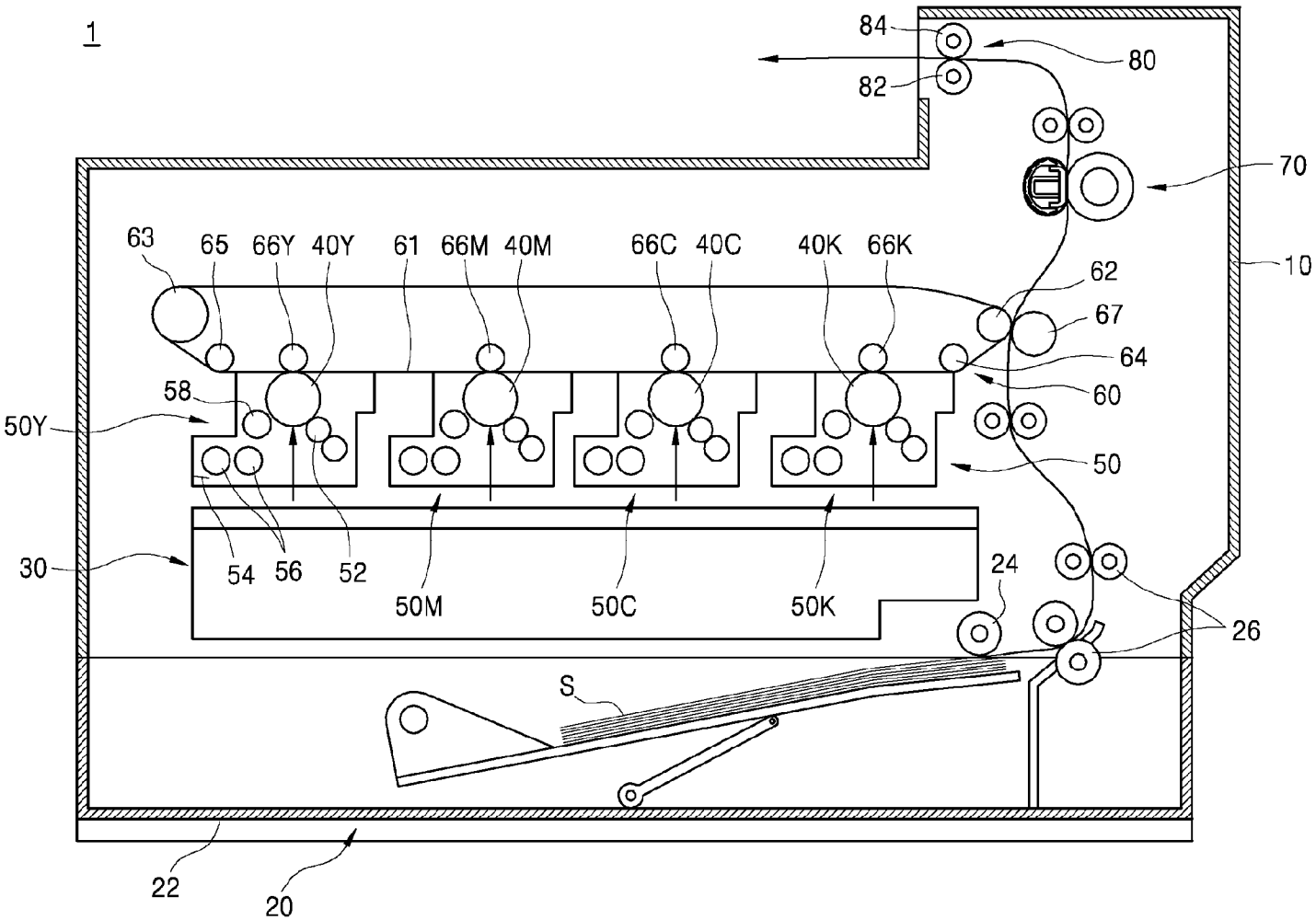
FIG. 1 is a schematic view illustrating an electrophotographic image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a schematic view illustrating an electrophotographic image forming apparatus 1 according to an exemplary embodiment of the present general inventive concept.

As illustrated in FIG. 1, the electrophotographic image forming apparatus 1 (hereinafter "the image forming apparatus 1") includes a main body 10, a recording medium supply unit 20, a light scanning unit 30, a plurality of photosensitive media 40Y, 40M, 40C, and 40K, respectively, a developing unit 50, a transfer unit 60, a fusing unit 70, and a recording medium discharge unit 80.

The main body 10 is an outer case of the image forming apparatus 1 and supports various parts installed therein. A portion of the main body 10 may be configured to be openable and closable. A user may replace or repair various parts or remove a jammed recording medium through an opened portion of the main body 10.

The recording medium supply unit 20 supplies a recording medium (S) toward the transfer unit 60. The recording medium supply unit 20 includes a cassette 22 in which the recording medium (S) is stored, a pickup roller 24 picking up the stored recording medium (S) one by one, and transport rollers 26 transporting the picked up recording medium (S) toward the transfer unit 60.

The light scanning unit 30 irradiates light corresponding to image information onto the photosensitive media 40Y, 40M, 40C, and 40K to form latent images on surfaces of the photosensitive media 40Y, 40M, 40C, and 40K, respectively. The light scanning unit 30 may include a light source irradiating a light beam, a deflector deflecting the light beam irradiated through a polygon mirror rotated by a motor, and an F-theta lens converging the deflected light beam onto the photosensitive media. (not illustrated)

The developing unit 50 supplies toner and a developing agent to the latent images formed on the photosensitive media 40Y, 40M, 40C, and 40K to form a visible toner image thereon. The developing unit 50 may include four developers 50Y, 50M, 50C, and 50K containing developing agents corresponding to different colors, for example, yellow (Y), magenta (M), cyan (C), and black (K), respectively, but may not be limited thereto.

The image forming apparatus 1 may form color images using cyan (C), magenta (M), yellow (Y), and black (K) toners, but is not limited thereto.

According to an exemplary embodiment of the present general inventive concept, each of the developers 50Y, 50M, 50C, and 50K, respectively, has a charger 52, a developing agent storing part 54, a developing agent transport member 56, and a developing member 58. The charger 52 charges the surfaces of the photosensitive media 40Y, 40M, 40C, and 40K, respectively, prior to forming the latent image on the surfaces of the photosensitive media 40Y, 40M, 40C, and 40K, respectively. The developing agent stored in the developing agent storing part 54 is transported toward the developing member 58 by the developing agent transport member 56, and the developing member 58 supplies the developing agent to the latent images formed on the photosensitive media 40Y, 40M, 40C, and 40K, respectively, to form visible images.

Referring to FIG. 1, each of the four photosensitive media 40Y, 40M, 40C, and 40K is included in the corresponding developers 50Y, 50M, 50C, and 50K, respectively.

The image forming apparatus 1 may also have a configuration where all four developers 50Y, 50M, 50C, and 50K form visible toner images on one of the photosensitive medium 40Y, 40M, 40C, and 40K.

The transfer unit 60 may include a transfer belt 61, a driving roller 62, a support roller 63, tension rollers 64 and 65, and transfer rollers 66Y, 66M, 66C, and 66K, respectively. The transfer unit 60 receives the visible image formed on the photosensitive media 40Y, 40M, 40C, and 40K, respectively, and transfers the received visible image onto the recording medium (S).

The transfer belt 61 is supported to be rotatable by the driving roller 62 and the support roller 63. The driving roller 62 receives power from a driving source (not illustrated) installed in the main body 10 and rotates. The support roller 63 is disposed at an opposite side to the driving roller 62 so as to support an inner surface of the transfer belt 61.

According to an exemplary embodiment of the present general inventive concept, an outer circumferential surface of a lower portion of the transfer belt 61 faces the respective photosensitive media 40Y, 40M, 40C, and 40K. The transfer rollers 66Y, 66M, 66C, and 66K are disposed on a top of an inner circumferential surface of the lower portion of the transfer belt 61 corresponding to the respective photosensitive media 40Y, 40M, 40C, and 40K.

When the image forming apparatus 1 performs a color printing operation, the transfer rollers 66Y, 66M, 66C, and 66K, respectively, are pressed toward the respective photosensitive media 40Y, 40M, 40C, and 40K. Then, the respective visible images formed on the photosensitive media 40Y, 40M, 40C, and 40K are transferred onto the transfer belt 61 by the transfer rollers 66Y, 66M, 66C, and 66K, respectively, overlapping one another. The images transferred onto the transfer belt 61 are further transferred onto the recording medium (S), which is supplied from the recording medium supply unit 20 and passes between the transfer rollers 66Y, 66M, 66C, and 66K, respectively, and the transfer belt 61.

When the image forming apparatus 1 performs a black-and-white printing operation, the transfer roller 66K is pressed toward the corresponding photosensitive medium 40K, and the remaining transfer rollers 66Y, 66M, and 66C are spaced apart from the corresponding photosensitive media 40Y, 40M, and 40C, respectively.

The recording medium (S) that has passed through the transfer unit 60 enters the fusing device 70. The fusing device 70 applies heat and pressure to the recording medium (S) and fixes a non-fused toner image onto the recording medium (S).

The recording medium (S) that has passed through the fusing device 70 is guided to the recording medium discharge unit 80 and discharged therefrom. The recording medium discharge unit 80 includes a discharge roller 82 and a discharge backup roller 84 installed to face the discharge roller 82.

Figure 2:
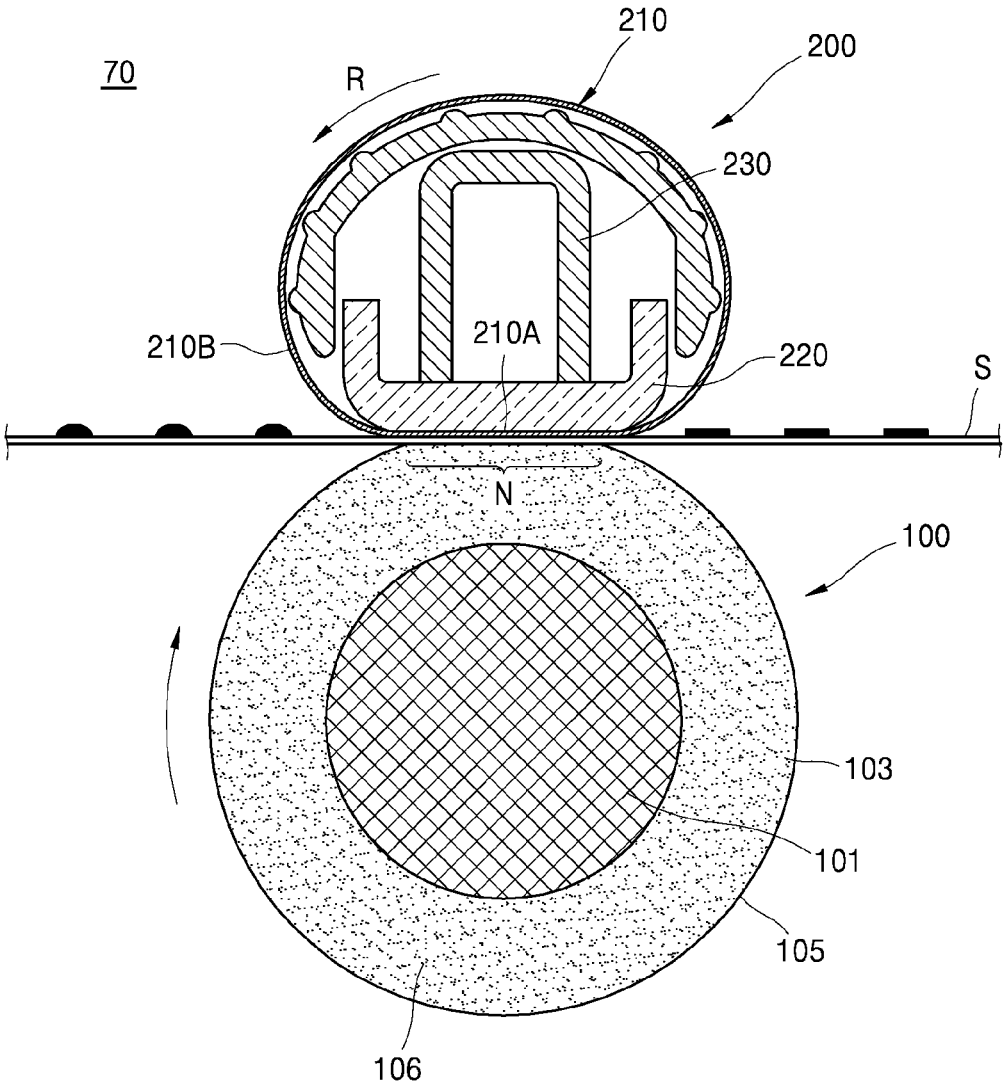
FIG. 2 is a schematic cross-sectional view of a fusing device included in the image forming apparatus illustrated in FIG. 1.

FIG. 2 is a schematic cross-sectional view of the fusing device illustrated in FIG. 1.

Referring to FIG. 2, the fusing device 70 may include a rotatable pressing unit 100, for example, a pressing roller 106, and a heating unit 200 to transfer heat.

The heating unit 200 and the pressing unit 100 are disposed facing each other to form a fusing nib (N) through which the recording medium (S) passes. The heating unit 200 transfers heat onto a surface of the recording medium (S) on which the non-fused toner image is formed.

The pressing unit 100 is disposed in pressing contact with the heating unit 200. The pressing unit 100 is disposed to face the heating unit 200, and presses (or closely contacts) the heating unit 200 with a predetermined pressure to form a fusing nib (N). The pressing unit 100 receives power from a driving source, (not illustrated) which is installed in the main body 10 of the image forming apparatus 1 and rotates. When the recording medium (S) having the toner image transferred thereon passes through the fusing nib (N) between the pressing unit 100 and the fusing belt 210, the toner image is fixed on the recording medium (S) by heat and pressure.

The pressing unit 100 includes a shaft 101 and an elastic layer 103. The shaft 101 is disposed at a center of the pressing unit 100 and functions as a rotational axis. The shaft 101 may be formed of a metal material, such as aluminum or steel, but is not limited thereto. The elastic layer 103 is disposed to cover the shaft 101, and is elastically deformed to form the fusing nib (N) when the pressing unit 100 pressingly contacts the fusing belt 210. The elastic layer 103 may be a heat-resistant elastomer such as a silicon elastomer, a fluorine elastomer, or the like, but is not limited thereto. A release layer 105, which prevents the recording medium (S) from attaching to a pressing roller 106 of the pressing unit 100, may be formed on a surface of the elastic layer 103. The release layer 105 may include one of perfluoroalkoxy (PFA), polytetrafluoroethylenes (PTFE), fluorinated ethylene prophylene (FEP), blends of two or more thereof, or copolymers of thereof, but is not limited thereto.

As illustrated in FIG. 2, the heating unit 200 includes an endless fusing belt 210 and a nib forming unit 220 disposed inside the fusing belt 210.

The fusing belt 210 may include a nib section 210A and a tension-free section 210B. The nib section 210A of the fusing belt 210 is pressed by the pressing unit 110 to contact an outer surface of the pressing unit 100, and rotates by being driven by the pressing unit 100. The tension-free section 210B is not in contact with the pressing unit 100, thus tension is released therefrom.

The nib forming unit 220 contacts an inner surface of the fusing belt 210 to form a fusing nib (N) between the pressing unit 100 and the fusing belt 210. The nib forming unit 220 is coupled to a support member 230. The nib forming unit 220 presses an inner circumferential surface of the fusing belt 210 when the pressing unit 100 presses the corresponding outer circumferential surface of the fusing belt 210.

The fusing belt 210 may be damaged or may not rotate smoothly when a friction force between the fusing belt 210 and the nib forming unit 220 increases. A lubricant (not illustrated), such as grease, but is limited thereto, may be used to coat the inner surface of the fusing belt 210 so as to reduce the frictional force between the fusing belt 210 and the nib forming unit 220.

Figure 3:
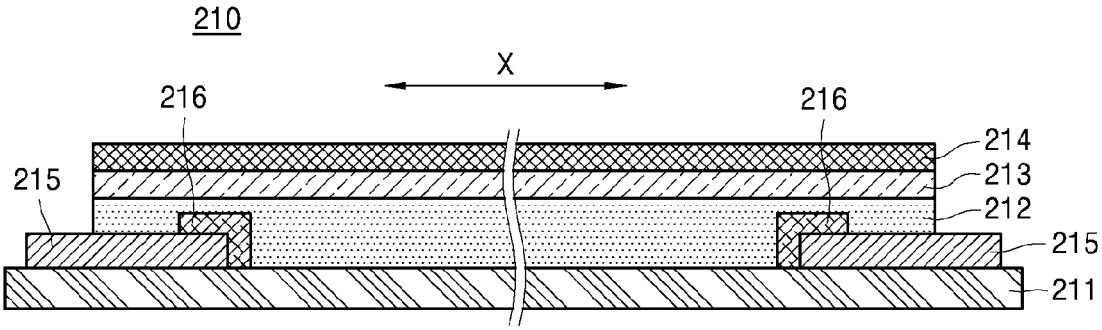
FIG. 3 is a cross-sectional view of a fusing belt of the fusing device illustrated in FIG. 2, taken in a lengthwise direction.

FIG. 3 is a cross-sectional view taken in a lengthwise (i.e., longitudinal) direction (X) of the fusing belt 210 illustrated in FIG. 2.

Referring to FIG. 3, the fusing belt 210 is a heating fusing belt, and may have a stack structure including a plurality of layers. The fusing belt 210 may include a base layer 211, a resistance heating layer 212 formed on a top of the base layer 211, and a release layer 214 formed on a top of the heating layer 212.

The base layer 211 may function as a layer to support the resistance heating layer 212. The base layer 211 may be formed of a plastic material, such as a heat resistant resin, or a metal material, but is not limited thereto. The heat resistant resin may be polyimide or polyimideamide, but is not limited thereto.

Figure 4A:
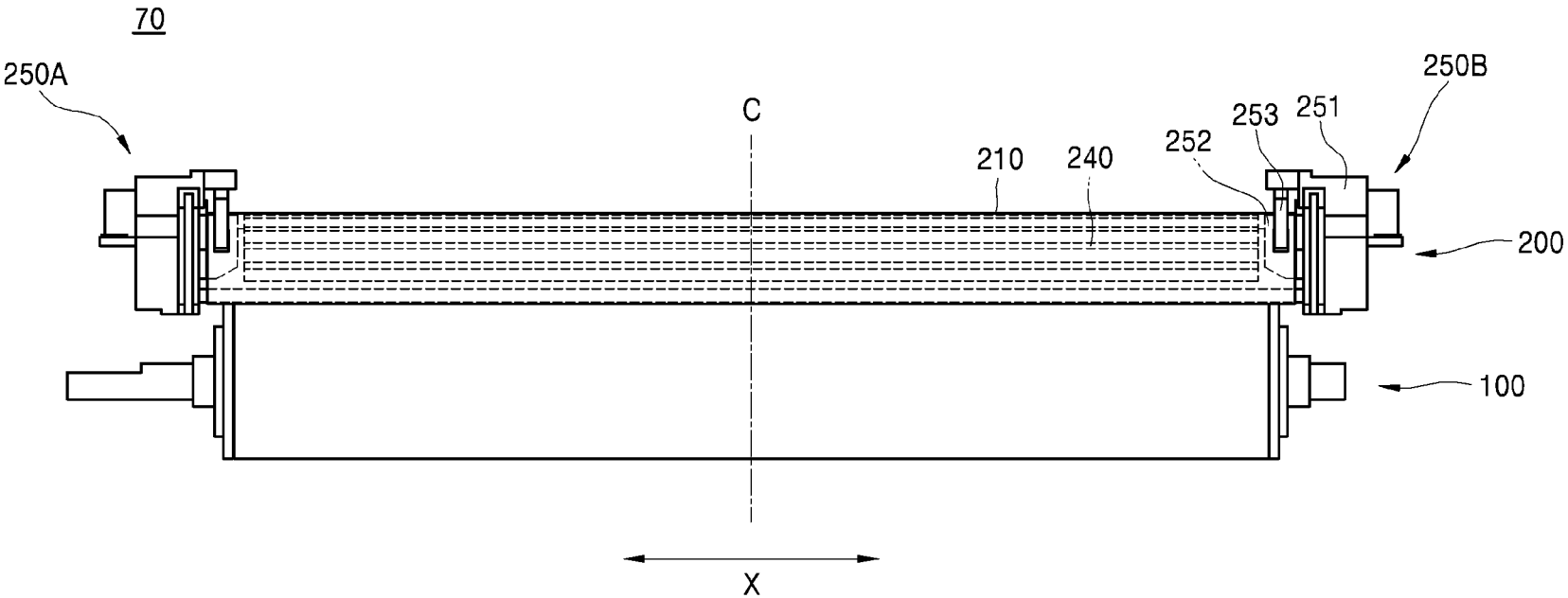
FIG. 4A is an assembled view and FIG. 4B is a disassembled view of a fusing device according to an exemplary embodiment of the present general inventive concept, respectively.
Figure 4B:
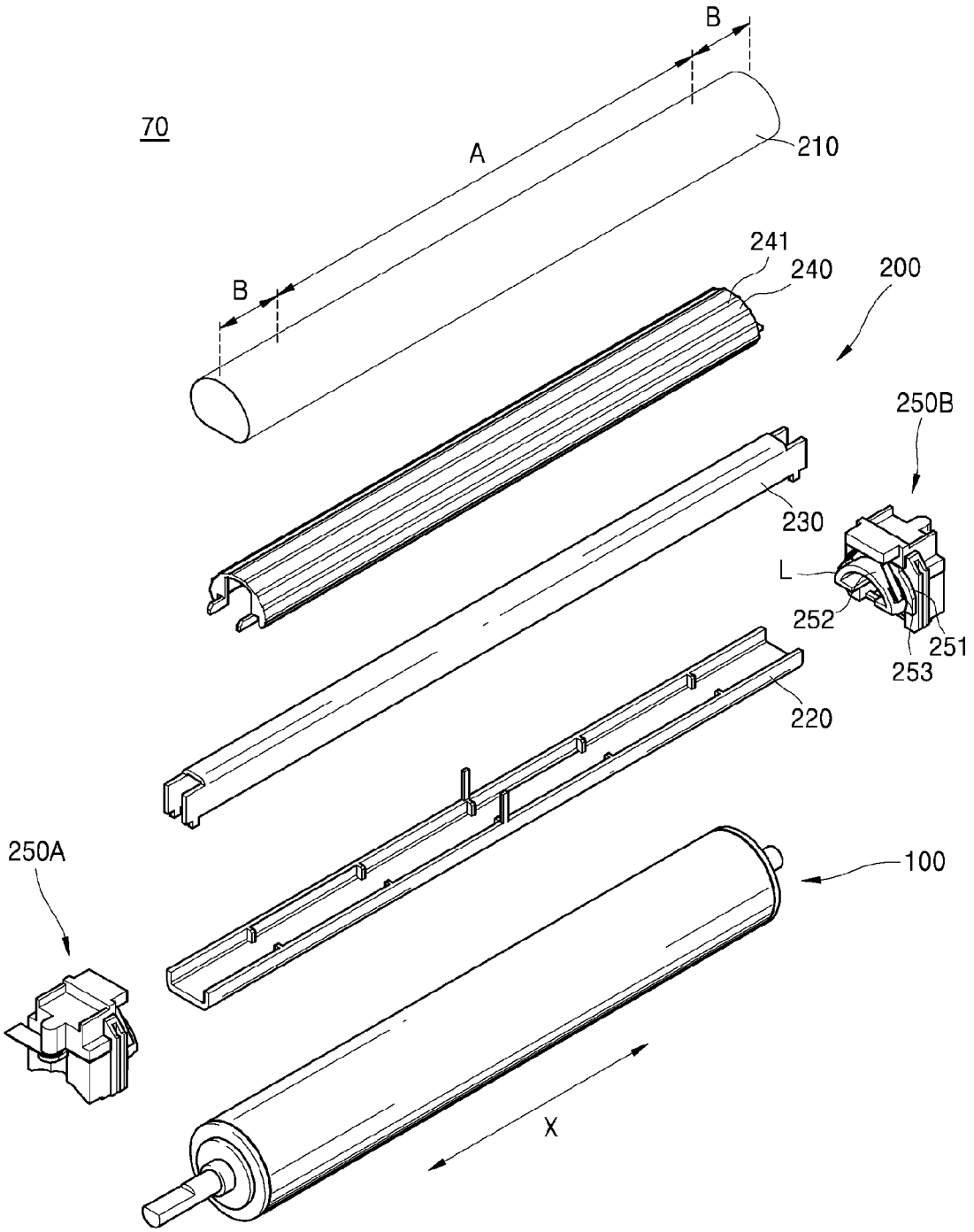

The resistance heating layer 212 may provide heat to the heating unit 200 upon connecting to a power supply part 253 illustrated in FIG. 4B. As the resistance heating layer 212 functions as a heat source of the heating unit 200, a heat loss generated during heating of the fusing belt 210 may be minimized, which enables the image forming apparatus 1 to perform a quick switch from a standby mode to a printing mode.

The resistance heating layer 212 may include a base polymer and an electrical conductive filler dispersed in the base polymer. The base polymer may include a heat resisting material to endure a fusing temperature, such as a heat resistant resin or a heat resistant elastomer, but is not limited thereto. The heat resistant resin may be polyimide or polyimideamide, but is not limited thereto. The heat-resistant elastomer may be a silicon elastomer, a fluorine elastomer, or the like, but is not limited thereto. The base polymer may also be any one of the above-mentioned materials, or blends or copolymers thereof, but is not limited thereto.

More than one type of electrical conductive filler may be dispersed in the base polymer, such as a metal-based filler or a carbon-based filler, but may not be limited thereto. Examples of the carbon-based filler may include carbon black, carbon nanotube (CNT), cup-stacked carbon nanotube, carbon fiber, carbon nanofiber, carbon nanocoil, fullerene, graphite, expanded graphite, graphite nano platelet, graphite oxide (GO), and the like, but are limited thereto. The electrical conductive filler may include one of the above-mentioned materials or combinations thereof, but is not limited thereto.

According to an exemplary embodiment of the present general inventive concept, when a multi-walled carbon nanotube (MWNT) is employed as the electrical conductive filler, the content of the electrical conductive filler may be about 10-40% in weight.

The resistance heating layer 212 may become an electrical conductor or a resistor when the electrical conductive filler is dispersed in the base polymer to form an electrical conductive network.

The resistance heating layer 212 may also be filled with the carbon nanotube, which has a conductivity close to metal and a very low density, and therefore has a heat capacity per unit volume 3 to 4 times lower than that of a general resistance material. Such characteristics of the carbon nanotube may allow the resistance heating layer 212 of the fusing belt 210 to exhibit a very fast temperature change, so that the image forming apparatus 1 may switch quickly from the standby mode to the printing mode to rapidly perform a first printing operation.

The resistance heating layer 212 may also be a metal heating layer, such as an Ag—Pd alloy layer, an Ag—Pt alloy layer, a Ni—Sn alloy layer, or the like, but is not limited thereto. An electrical insulating layer may be disposed between the base layer 211 and the resistance heating layer 212. (not illustrated)

An electrode 215 to supply a current to the resistance heating layer 212 is disposed at both end portions of the fusing belt 210 in the lengthwise or longitudinal direction (X) of the fusing belt 210. The electrode 215 may be formed of a low resistance metal and connected to the resistance heating layer 212. A conductive paste 216 may be disposed between the electrode 215 and the resistance heating layer 212 to reduce a contact resistance while maintaining a connection there between.

The conductive paste 216 may include an Ag paste, but is not limited thereto.

The electrode 215 is exposed to connect to the power supply part 253 illustrated in FIG. 4B.

The release layer 214 may form an outermost layer of the fusing belt 210.

When the recording medium (S) deviating from the fusing nib (N) is not separated from the fusing belt 210 and is attached to the surface of the fusing belt 210, an offset phenomenon may occur, where toner on the recording medium (S), which is fused in the fusing operation, is fused on the surface of the fusing belt 210. The offset phenomenon may cause a portion of a printing image on the recording medium (S) to be omitted and paper jamming. The release layer 214 may be a resin layer having superior separation property, for example, a fluorine resin layer, but is not limited thereto. Examples of the fluorine resin may include one of perfluoroalkoxy (PFA), polytetrafluoroethylenes (PTFE), fluorinated ethylene prophylene (FEP), blends of two or more thereof, or copolymers of thereof, but are not limited thereto.

The fusing belt 210 may further include an insulating elastic layer 213 on an inner surface of the release layer 214, i.e., between the release layer 214 and the resistance heating layer 212. The insulating elastic layer 213 provides elasticity to the fusing belt 210 so as to easily form the fusing nib (N). The insulating elastic layer 213 may be formed of a material having electrical insulation property and heat resistance property to endure the fusing temperature. The insulating elastic layer 213 may include a rubber material, such as fluorine rubber, silicon rubber, natural rubber, isoprene rubber, butadiene rubber, nitrile rubber, chloroprene rubber, butyl rubber, acryl rubber, hydrine rubber, urethane rubber, or the like, but is not limited thereto.

The insulating elastic layer 213 may also include an elastomer, such as styrene-based elastomer, polyolefin-based elastomer, polychloride vinyl-based elastomer, polyurethane-based elastomer, polyester-based elastomer, polyamide-based elastomer, polybutadiene-based elastomer, transpolyisoprene-based elastomer, chlorinated polyethylene-based elastomer, and the like, or blends thereof, or copolymers thereof, but is not limited thereto.

In the above-described exemplary embodiment, since the fusing belt 210 including the resistance heating layer 212 generates heat, it is possible to rapidly perform a first printing operation. However, since the resistance heating layer 212 is disposed inside the fusing belt 210 of the fusing device 70, any local damage of the fusing belt 210 may lead to a near ignition situation. According to an exemplary embodiment of the present general inventive concept, the local damage of the fusing belt 210 associated with the near ignition situation of the fusing device 70 may be prevented.

FIGS. 4A and 4B are respectively an assembled view and a disassembled view of the fusing device 70 according to an embodiment of the present general inventive concept.

Referring to FIGS. 2, 4A, and 4B, the fusing device 70 includes the heating unit 200 and the pressing unit 100. The lengthwise direction (X) of the fusing device 70 is defined as a direction corresponding to the axial direction of the pressing unit 100. The lengthwise direction (X) of the fusing device 70 may be expressed as a lengthwise direction of a part constituting the heating unit 200 of the fusing unit 70, for example, the fusing belt 210, the nib forming unit 220, or the second guide unit 240.

The fusing belt 210 has an endless shape, and extends in the lengthwise direction (X). The fusing belt 210 may have a paper passing region (A) through which the recording medium (S) passes, and a paper non-passing region (B) through which the recording medium does not pass. Both end portions of the fusing belt 210 are included in the paper non-passing region (B), and a central portion of the fusing belt 210 may be included in the paper passing region (A).

Side frames 250A and 250B in one pair may be disposed at both end portions of the fusing belt 210, respectively. Each of the side frames 250A and 250B, respectively, has a regulation wall 251 to limit movement of the fusing belt 210 in the lengthwise (X) direction, a first guide unit 252 to support an inner surface of the end of the fusing belt 210, and a power supply part 253 to supply power to the resistance heating layer 212 of the fusing belt 210.

According to an exemplary embodiment of the present general inventive concept, the first guide unit 252 is protruded from the regulation wall 251 and is disposed inside of the fusing belt 210. An outer circumferential surface of the first guide unit 252 may support the inner circumferential surface of the end of the fusing belt 210 to guide rotational movements of both end portions of the fusing belt 210, respectively. The power supply part 253 may contact the fusing belt 210 at two or more points to establish a stable electrical contact with the fusing belt 210.

The first guide unit 252 may support the inner circumferential surfaces of both end portions of the fusing belt 210. The first guide unit 252 may be formed in an arc shape, but is not limited thereto. For example, the first guide unit 252 may have a shape supporting the inner circumferential surfaces of the fusing belt 210, a shape supporting the outer circumferential surface of the fusing belt 210, or a shape supporting both the inner circumferential surface and the outer circumferential surface of the fusing belt 210 at the same time.

The support member 230 and the nib forming unit 220 are disposed in the lengthwise direction (X) of the fusing device 70 between the side frames 250A and 250B in one pair. Since the support member 230 functions as a basic frame to support the parts constituting the heating unit 200, the support member 230 may be formed of a material having a high rigidity such that the heating unit 200 is not deformed by an external force. Each of the end portions of the support member 230 and the nib forming unit 220 is coupled to one of the side frames 250A and 250B, respectively, at a corresponding end, such that the support member 230 extends between the side frames 250A and 250B in the lengthwise direction (X). The support member 230 may form a frame structure of the heating unit 200 together with the side frames 250A and 250B.

The nib forming unit 220 is disposed inside the fusing belt 210, and extends in the lengthwise direction (X) to contact the inner surface of the fusing belt 210. The fusing nib (N) is formed at the contact portion between the pressing unit 100 and the fusing belt 210. The nib forming unit 220 is coupled to the support member 230, and each of two end portions of the nib forming unit 220 is coupled to the side frames 250A and 250B, respectively.

The second guide unit 240 is disposed inside the fusing belt 210 between the two first guide units 252, and extends in the lengthwise direction (X) of the fusing belt 210 to maintain the shape of the central portion of the fusing belt 210 and to guide the rotational movement of the central portion of the fusing belt 210. In particular, when the fusing belt 210 is rotatably driven by the pressing unit 100, the first guide unit 252 maintains the shapes of both end portions of the fusing belt 210, and the second guide unit 240 maintains the shape of the central portion of the fusing belt 210, thereby preventing distortions at corresponding end and central portions, respectively.

Figure 5A:
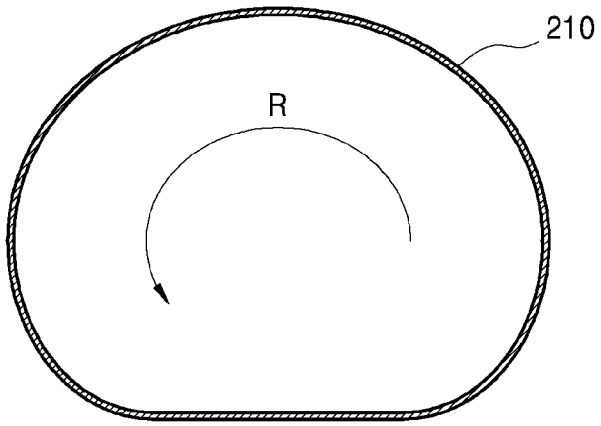
FIGS. 5A and 5B are cross-sectional views illustrating shapes of an end portion and a central portion of a fusing belt when a fusing device does not include a second guide unit.
Figure 5B:
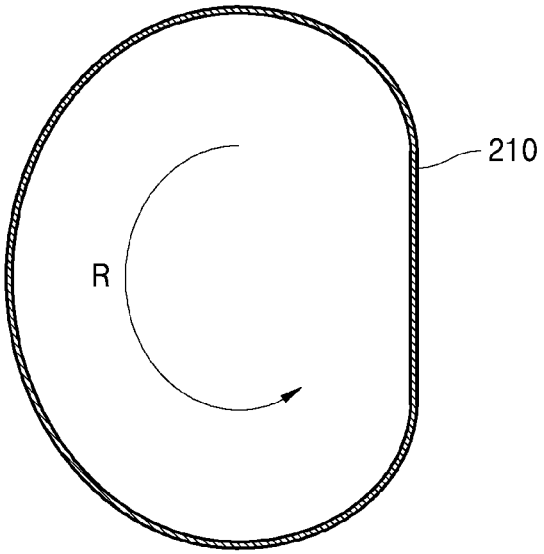
Figure 6A:
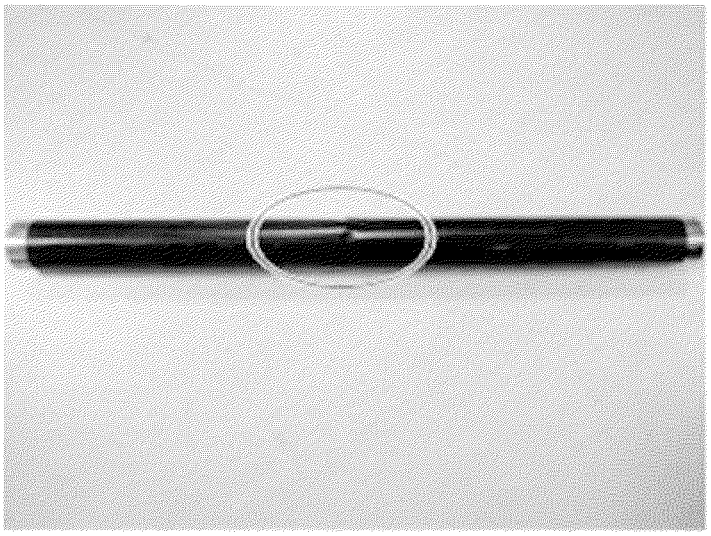
FIG. 6A illustrates a damaged state of a fusing belt when a fusing device does not include a second guide unit.
Figure 6B:
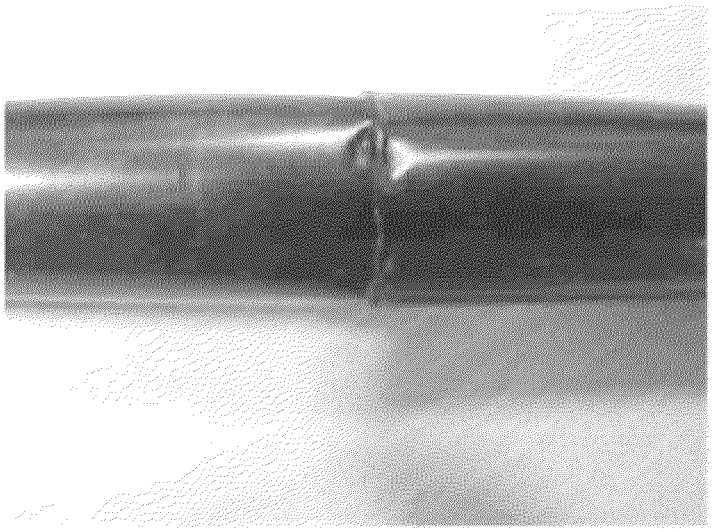
FIG. 6B is an enlarged view of a selected portion in FIG. 6A.

FIGS. 5A and 5B are cross-sectional views illustrating shapes of an end portion and a central portion of a fusing belt 210 when a fusing device 70 does not include the second guide unit 240, FIG. 6A illustrates a damaged state of the fusing belt 210 illustrated in FIGS. 5A and 5B, and FIG. 6B is a magnified image of the damaged portion in FIG. 6A.

Referring to FIGS. 5A and 5B, when the fusing device 70 does not include the second guide unit 240, distortion may occur between the central portion and the end portions of the fusing belt 210, respectively. More specifically, without the second guide unit 240, both end portions of the fusing belt 210 rotate in a state where a predetermined belt position of the fusing belt 210 is maintained as illustrated in FIG. 5A, but the central portion fails to maintain the predetermined belt position and instead rotates in a deformed state as illustrated in FIG. 5B. Accordingly, when this type of severe distortion of the fusing belt 210 occurs, as illustrated in FIG. 6B, the fusing belt 210 may be severely damaged. Moreover, when the fusing belt 210 includes the resistance heating layer 212, the fusing belt 210 exhibits a tendency to maintain the deformed state at an initial stage of printing, owing to a characteristic of the material included in the heating layer 212.

However, according to an exemplary embodiment of the present general inventive concept, since the second guide unit 240 is disposed between the first guide units 252 to maintain the shape of the central portion of the fusing belt 210 the distortion between the end portions and the central portion may be prevented.

Figure 7A:
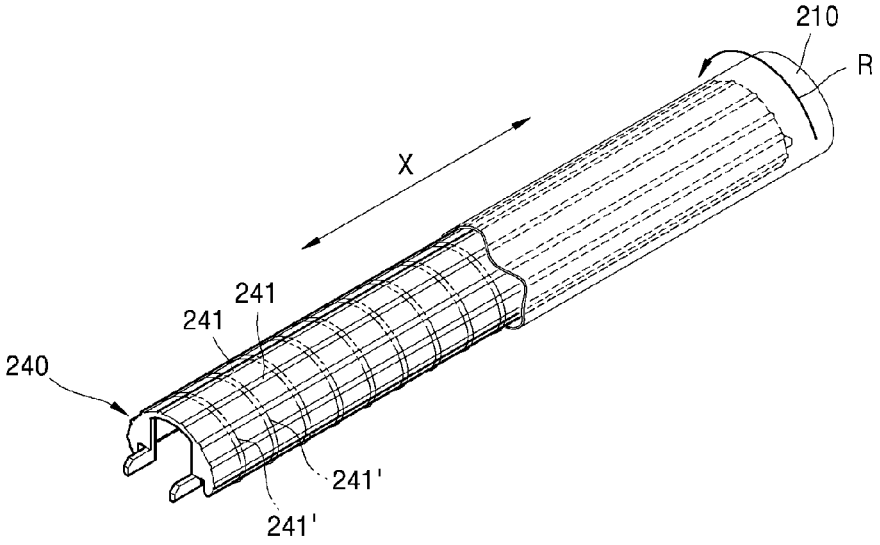
FIG. 7A is a perspective view of a fusing belt and a second guide unit to maintain a shape of the fusing belt illustrated in FIG. 4B.
Figure 7B:
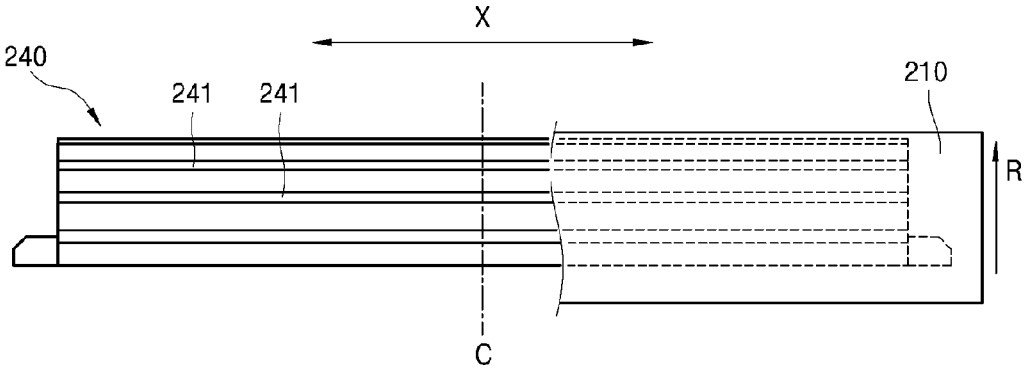
FIG. 7B is a front view of the same.

FIG. 7A is a perspective view and FIG. 7B is a front view of a fusing belt 210 and a second guide unit 240 that operate together to maintain the shape of the fusing belt 210, as illustrated in FIG. 4B. A portion of the fusing belt 210 is omitted in FIGS. 7A and 7B.

Referring to FIGS. 7A and 7B, a plurality of ribs 241 is disposed on an outer circumferential surface of the second guide unit 240, protruded outwardly therefrom to contact the fusing belt 210. By forming the plurality of ribs 241 on the outer circumferential surface of the second guide unit 240, a contact area of the second guide unit 240 with the fusing belt 210 may be minimized. As illustrated in FIG. 3, when the fusing belt 210 includes the resistance heating layer 212, the fusing belt 210 is formed of a material having a small heat capacity so as to enhance the temperature rising rate. When the second guide unit 240 contacts the fusing belt 210 having a small heat capacity, an increase in contact area leads to a reduction in temperature rising rate. Formation of the plurality of ribs 241 makes it possible to minimize a contact area between the second guide unit 240 and the fusing belt 210, thereby preventing the reduction in temperature rising rate of the fusing belt 210.

The formation of the plurality of protruded ribs 241 in a limited contact area may also decrease a frictional force between the second guide unit 240 and the fusing belt 210, and thus reduces a torque driving force consumed in the pressing unit 100 to rotate the fusing belt 210. The reduced torque driving force is required for a fusing device 70 to perform a fast initial printing.

As described above, the plurality of protruded ribs 241 is formed on the outer circumferential surface of the second guide unit 240 to contact the fusing belt 210 in a limited area. However, the temperature of the fusing belt 210 in the contact area may be locally changed, and the contact areas may be subject to a repeated friction. This phenomenon may deteriorate picture quality in the short term and endurance of the fusing belt 210 in the long term.

According to an exemplary embodiment of the present general inventive concept, the plurality of ribs 241 is arranged spaced apart from one another along the rotational direction (R) of the fusing belt 210. Each of the ribs 241 may be formed extending in a direction crossing the rotational direction (R) of the fusing belt 210.

Each of the plurality of ribs 241 may be formed extending in a direction perpendicular to the rotational direction (R) of the fusing belt 210. Since each of the plurality of ribs 241 is continuously formed extending in the lengthwise direction (X) of the fusing belt 210, each of the ribs 241 may continuously contact the fusing belt 210 in the lengthwise direction (X).

If each of the plurality of ribs 241 does not continuously contact the fusing belt 210 in the lengthwise direction (X), the fusing belt 210 may repeatedly contact each of the plurality of ribs 241 only at a specific region in the lengthwise direction (X). For example, when each of a plurality of ribs 241' is formed extending in parallel with the rotational direction (R) of the fusing belt 210, as illustrated in FIG. 7A by two-dot chain lines, and are arranged spaced apart from one another in the lengthwise (X) direction, the fusing belt 210 repeatedly contacts the ribs 241' only at a specific region corresponding to the plurality of ribs 241'.

Figure 8:
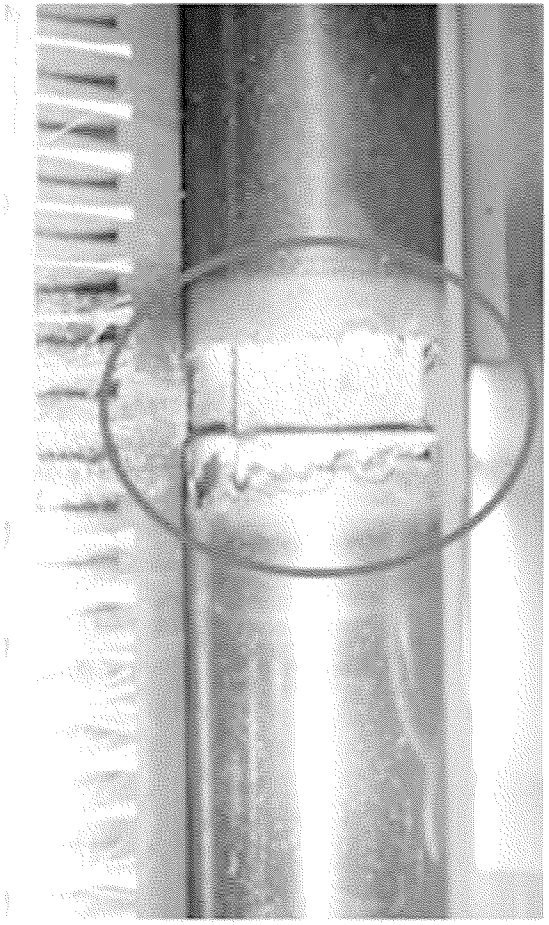
FIG. 8 illustrates a damaged state of a fusing belt when a second guide unit having a rib extended in parallel to a rotational direction of the fusing belt is used during a long time.

FIG. 8 illustrates a damaged appearance of the fusing belt 210 when a second guide unit 240 having the plurality of ribs 241' extended in parallel to the rotational direction (R) of the fusing belt 210 is used during a long time. Referring to FIG. 8, the fusing belt 210 was locally damaged at a contact portion with the plurality of ribs 241' due to a repeated friction with the plurality of ribs 241' at a specific region, so that local ignition was generated by the resistance heating layer 212 included therein.

According to an exemplary embodiment of the present general inventive concept, since each of the plurality of ribs 241 is formed to extend in the direction crossing the rotational direction (R) of the fusing belt 210, the plurality of ribs 241 may continuously contact the fusing belt 210 in the lengthwise direction (X). Therefore, damage to the fusing belt 210 may be prevented because the plurality of ribs 241 does not continuously contact the fusing belt 210 only at a specific region in the lengthwise direction (X). Each of the plurality of ribs 241 may be formed entirely on a whole region of the second guide 240 in the lengthwise direction (X) of the second guide 240.

In the above-described exemplary embodiment of the present general inventive concept, the plurality of ribs 241 may be formed to extend in the direction crossing the rotational direction (R) of the fusing belt 210, for example, in the direction perpendicular to the rotational direction (R) of the fusing belt 210, but is not limited thereto. A plurality of ribs 241A may be formed extending in a direction having an acute angle to the rotational direction (R) of the fusing belt 210 to avoid a repeated frictional contact of the rib 241A with a specific region of the fusing belt 210, and to prevent a leakage of a lubricant disposed between the fusing belt 210 and the second guide unit 240.

The plurality of ribs 241A may also be formed symmetrically with respect to a center line (C) of the fusing belt 210 in the lengthwise direction (X) to further prevent meandering of the fusing belt 210.

Figure 10A:
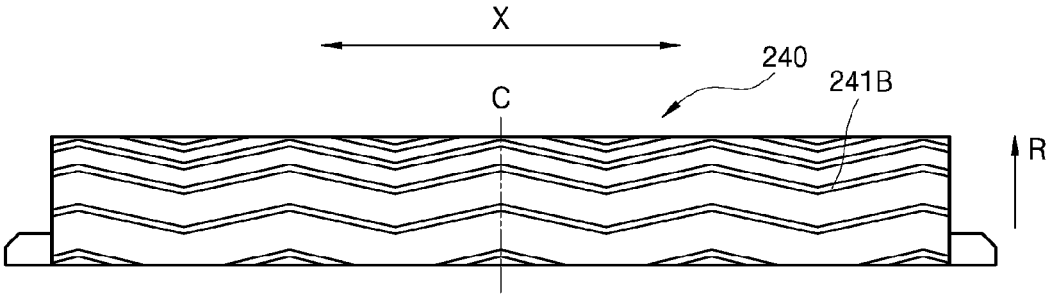
FIGS. 10A, 10B, and 10C are front views of a second guide unit according to exemplary embodiments of the present general inventive concept.
Figure 10B:
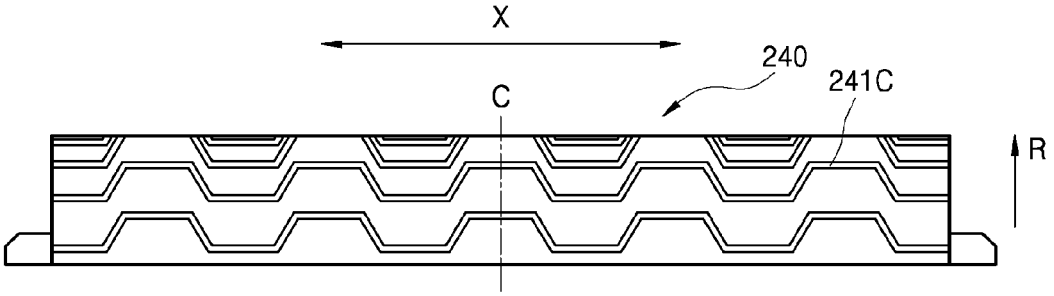
Figure 10C:
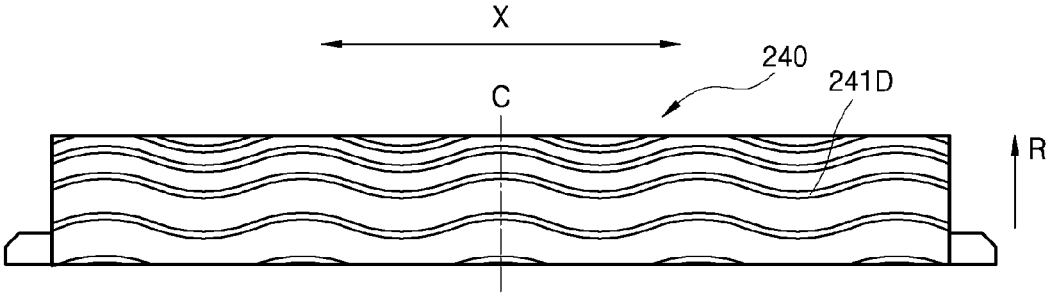

Referring to FIG. 10, the plurality of ribs 241 and 241A, respectively, may have various shapes continuously disposed in the direction crossing the rotational direction (R) of the fusing belt 210. For example, the plurality of ribs 241B, 241C, and 241D, respectively, may be shaped in the lengthwise direction (X) in a zigzag pattern as illustrated in FIG. 10A, in a mixed pattern of a section perpendicular to the rotational direction (R) and a section having an acute angle as illustrated in FIG. 10B, or in a repeated pattern of curved sections as illustrated in FIG. 10C, but is not limited thereto.

Figure 9:
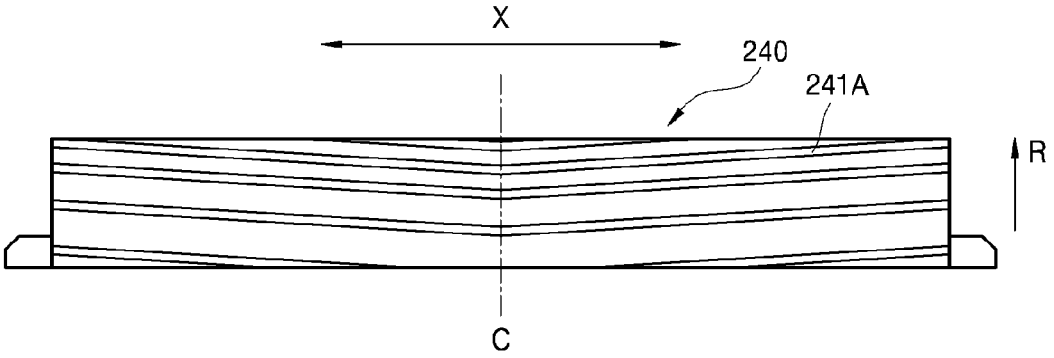
FIG. 9 is a front view of a second guide unit according to exemplary embodiments of the present general inventive concept.

The plurality of ribs 241A, 241B, 241C, and 241D may also be formed continuously on the whole region of the second guide unit 240 in the lengthwise direction (X), but is not limited thereto, and at least a portion of the plurality of ribs 241 may be intermittently formed in the lengthwise direction of the second guide unit 240. For example, as illustrated in FIGS. 9, 10A, and 10C, the plurality of ribs 241 disposed at an upper side among the plurality of ribs 241 may be formed continuously over the entire region in the lengthwise direction (X), and the rib 241 disposed at a lower side may be intermittently formed in the lengthwise direction (X).

Figure 11:
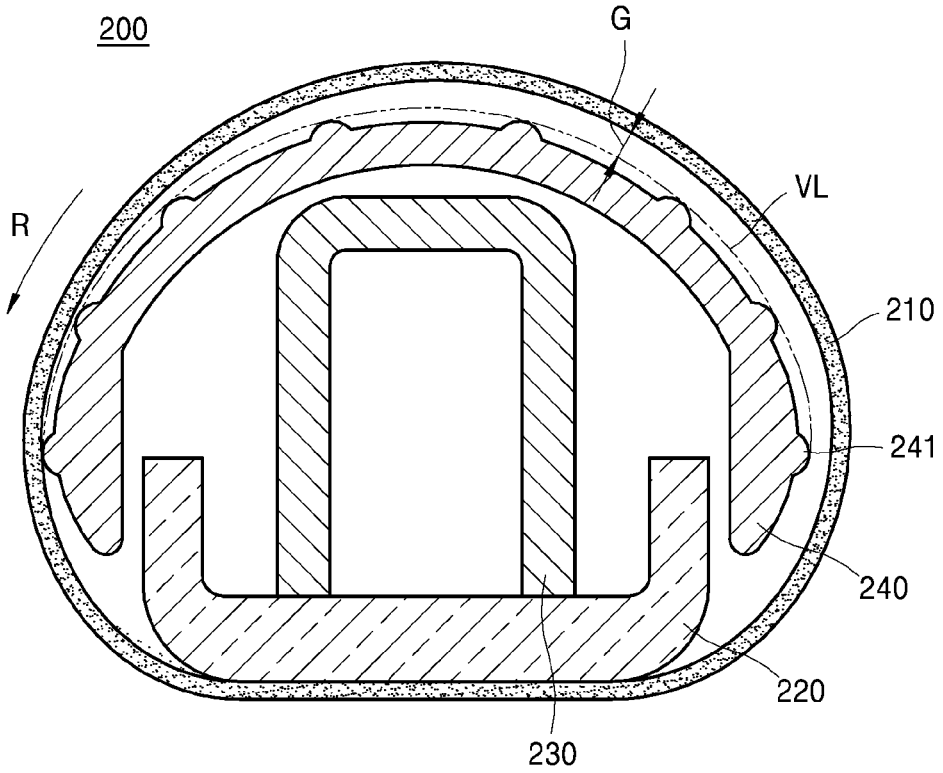
FIG. 11 is a detailed view of the heating unit illustrated in FIG. 2.

FIG. 11 is a detailed view of the heating unit 200 illustrated in FIG. 2. Referring to FIG. 11, at least a portion of the plurality of ribs 241 may have a gap (G) from the fusing belt 210 disposed at an outside thereof. A portion of the plurality of ribs 241 contacts the fusing belt 210, and the remaining portion may be spaced apart from the fusing belt 210 so as to have a predetermined gap (G) from the fusing belt 210. The gap (G) from the fusing belt 210 may prevent the rotating fusing belt 210 from being caught in between the nib forming unit 220 and the second guide unit 240, when the two parts disposed at a more inner side than the fusing belt 210 expand during a fusing and heating operation. By doing so, wear or damage of the fusing belt 210 may be minimized.

The gap (G) between the rib 241 and the fusing belt 210 may be smaller than about 0.3 mm. When the gap (G) exceeds 0.3 mm, the plurality of ribs 241 fails to contact the fusing belt 210, and the inherent function of the plurality of ribs 241 to maintain the inner shape of the fusing belt 210 may not be exerted.

Referring to FIG. 11, a virtual (or imaginary) line (VL) connecting the plurality of ribs 241 may correspond with at least a portion of a contour line (L) of the first guide unit 252 illustrated in FIG. 4B. The fusing belt 210 formed to extend in the lengthwise direction (X) between the guide parts 252 may maintain a predetermined shape during rotation.

While the present general inventive concept has been described with reference to the embodiments illustrated in the drawings, the embodiments are merely exemplary of the present general inventive concept. For example, the image forming apparatus 1 may form color images using cyan (C), magenta (M), yellow (Y), and black (K) toners, as described in the exemplary embodiments, but the present general inventive concept is not limited thereto. The image forming apparatus 1 may also form an image on a recording medium by using one color toner.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fusing device, comprising:

a pressing unit;

a heating fusing belt to contact an outer surface of the pressing unit and to rotate, including a heating layer;

a nib forming unit to contact an inner surface of the heating fusing belt and to form a nib at a contact portion between the pressing unit and the heating fusing belt;

first guide units disposed at both end portions of the heating fusing belt so as to guide the heating fusing belt; and a second guide unit disposed between the first guide units and having a plurality of ribs spaced apart from each other along a rotational direction of the heating fusing belt, so as to guide a central portion of the heating fusing belt, wherein the plurality of ribs are formed to extend in a direction perpendicular to the rotational direction of the heating fusing belt.

2. The fusing device of claim 1, wherein the plurality of ribs is formed to extend in a direction crossing the rotational direction of the heating fusing belt.

3. The fusing device of claim 2, wherein at least a portion of the plurality of ribs is formed to extend in a direction having an acute angle with the rotational direction of the heating fusing belt.

4. The fusing device of claim 1, wherein the plurality of ribs is formed symmetrically with respect to a center line in a lengthwise direction of the heating fusing belt.

5. The fusing device of claim 1, wherein the heating fusing belt has a nib section pressed by the pressing unit, and a tension-free section where tension is released.

6. The fusing device of claim 5, wherein the heating fusing belt comprises:

a base layer;

a resistance heating layer formed on the base layer; and a release layer formed on the resistance heating layer.

7. The fusing device of claim 6, wherein the resistance heating layer comprises a carbon nano tube.

8. The fusing device of claim 1, wherein a portion of the plurality of ribs has a gap between the heating fusing belt and the plurality of ribs.

9. The fusing device of claim 8, wherein the gap is smaller than about 0.3 mm.

10. The fusing device of claim 1, wherein an virtual line connecting the plurality of ribs corresponds to at least a portion of a contour line of the first guide unit.

11. The fusing device of claim 1, wherein the plurality of ribs is formed entirely along a lengthwise direction of the second guide unit.

12. The fusing device of claim 1, wherein the plurality of ribs is formed intermittently along a lengthwise direction of the second guide unit.

13. An electrophotographic image forming apparatus comprising:

a photosensitive medium on which an electrostatic latent image is formed;

a developer roller to supply toner onto the latent image to form a toner image on a recording medium;

a fusing device to apply heat and pressure to the toner image formed on the recording medium to fuse the toner image on the recording medium, the fusing device, comprising:

a pressing unit, a heating fusing belt to contact an outer surface of the pressing unit and to rotate, including a heating layer, a nib forming unit to contact an inner surface of the heating fusing belt and to form a nib at a contact portion between the pressing unit and the heating fusing belt, first guide units disposed at both end portions of the heating fusing belt so as to guide the heating fusing belt, and a second guide unit disposed between the first guide units and having a plurality of ribs spaced apart from each other along a rotational direction of the heating fusing belt, so as to guide a central portion of the heating fusing belt, wherein the plurality of ribs are formed to extend in a direction perpendicular to the rotational direction of the heating fusing belt.

14. The electrophotographic image forming apparatus of claim 13, wherein the plurality of ribs is formed extending in a direction crossing the rotational direction of the heating fusing belt.

15. The electrophotographic image forming apparatus of claim 14, wherein at least a portion of the plurality of ribs is formed to extend in a direction having an acute angle to the rotational direction of the heating fusing belt.

16. The electrophotographic image forming apparatus of claim 13, wherein the plurality of ribs is formed symmetrically to a center line in a lengthwise direction of the heating fusing belt.

17. The electrophotographic image forming apparatus of claim 13, wherein the heating fusing belt has a nib section pressed by the pressing unit, and a tension-free section where tension is released.

18. The electrophotographic image forming apparatus of claim 17, wherein the heating fusing belt comprises:

a base layer;

an resistance heating layer formed on the base layer; and a release layer formed on the resistance heating layer.

19. The electrophotographic image forming apparatus of claim 18, wherein the resistance heating layer comprises a carbon nano tube.

20. The electrophotographic image forming apparatus of claim 13, wherein a portion of the plurality of ribs has a gap between the heating fusing belt and the ribs.

21. The electrophotographic image forming apparatus of claim 20, wherein the gap is smaller than about 0.3 mm.

22. The electrophotographic image forming apparatus of claim 13, wherein a virtual line connecting the plurality of ribs corresponds to at least a portion of a contour line of the first guide unit.

23. The electrophotographic image forming apparatus of claim 13, wherein the plurality of ribs is formed entirely along a lengthwise direction of the second guide unit.

24. The electrophotographic image forming apparatus of claim 13, wherein the plurality of ribs is formed intermittently along a lengthwise direction of the second guide unit.

25. A fusing device of an image forming apparatus to perform a rapid temperature increase, comprising:

a pressing unit; and a heating unit to contact a portion of an outer surface of the pressing unit, comprising:

a fusing belt to rotate in a paper feeding direction, at least one guide unit to circumferentially guide the fusing belt around the guide unit in the paper feeding direction, and a plurality of ribs longitudinally disposed on an outer surface of the at least one guide unit in directions substantially perpendicular to the paper feeding direction.

26. The fusing device of claim 25, wherein each of the plurality of ribs is in continuous contact with a portion of an inner circumferential surface of the fusing belt to prevent distortion of a center portion of the fusing belt with respect to end portions of the fusing belt.

27. The fusing device of claim 25, wherein the at least one guide unit comprises:

first guide units disposed at end portions of the fusing belt; and a second guide unit disposed at a central portion of the fusing belt between the first guide units.

28. The fusing device of claim 27, wherein the central portion of the fusing belt is not distorted with respect to the end portions of the fusing belt.

29. The fusing device of claim 25, wherein each of the plurality of ribs is spaced apart from each other in the paper feeding direction.

30. The fusing device of claim 25, wherein the heating unit comprises a nib forming unit to press a portion of the fusing belt to contact a corresponding portion of the outer surface of the pressing unit.

31. The fusing device of claim 25, wherein the fusing belt rotates in response to a rotation of the pressing unit.

* * * * *

UNITED STATES PATENT AND TRADEMARK OFFICE

CERTIFICATE OF CORRECTION

PATENT NO. : 9,052,651 B2
APPLICATION NO. : 14/061219
DATED : June 9, 2015
INVENTOR(S) : Sang-uk Jeon It is certified that error appears in the above-identified patent and that said Letters Patent is hereby corrected as shown below:

Title Page, First Column, (54) (Title), Line 2

Delete "ELETROPHOTOGRAPHIC" and insert --ELECTROPHOTOGRAPHIC--, therefor.

Column 1 (Title), Line 2

Delete "ELETROPHOTOGRAPHIC" and insert --ELECTROPHOTOGRAPHIC--, therefor.

Signed and Sealed this
Twenty-seventh Day of October, 2015

Michelle K. Lee

Michelle K. Lee
*Director of the United States Patent and Trademark Office*